United States Patent [19]

Andrews

[11] Patent Number: 4,692,976

[45] Date of Patent: Sep. 15, 1987

[54] METHOD OF MAKING SCALABLE SIDE ENTRY TURBINE BLADE ROOTS

[75] Inventor: Robert P. Andrews, San Jose, Calif.

[73] Assignee: Westinghouse Electric Corp., Pittsburgh, Pa.

[21] Appl. No.: 872,987

[22] Filed: Jun. 11, 1986

Related U.S. Application Data

[63] Continuation-in-part of Ser. No. 760,387, Jul. 30, 1985, abandoned.

[51] Int. Cl.[4] ..... B21K 3/04

[52] U.S. Cl. ..... 29/156.8 B; 29/407; 29/557

[58] Field of Search ..... 29/156.8 B, 407, 557; 416/219 R, 219 A, 220 R

[56] References Cited

U.S. PATENT DOCUMENTS

| | | | |
|---|---|---|---|
| 3,317,988 | 5/1967 | Endres | 29/156.8 B |
| 3,887,987 | 6/1975 | Salt | 29/407 |
| 4,191,509 | 3/1980 | Leonardi | 416/219 R |
| 4,260,331 | 4/1981 | Goodwin | 416/219 R |

FOREIGN PATENT DOCUMENTS

| | | | |
|---|---|---|---|
| 724846 | 1/1966 | Canada | 29/156.8 B |
| 3236021 | 5/1983 | Fed. Rep. of Germany | 416/219 R |
| 817660 | 8/1959 | United Kingdom | 29/156.8 B |
| 836001 | 6/1960 | United Kingdom | 29/156.8 B |
| 445753 | 6/1975 | U.S.S.R. | 416/219 R |

OTHER PUBLICATIONS

John, James E. and William L. Haberman, *Introduction to Fluid Mechanics,* 2nd ed., Prentice Hall, Inc., Englewood Cliffs, N.J., 1980., pp. 132–139.

*Primary Examiner*—Howard N. Goldberg
*Assistant Examiner*—Irene Graves Golabi
*Attorney, Agent, or Firm*—F. J. Baehr

[57] ABSTRACT

A method for providing a scalable two tang side entry turbine blade root geometry which significantly reduces stress concentration due to centrifugal and bending load on the blade root by equalizing the stresses at all points of stress concentration utilizing a scalable model in which all of the dimensions can be multiplied by a constant to produce a range of different sized blade roots.

4 Claims, 2 Drawing Figures

METHOD OF MAKING SCALABLE SIDE ENTRY TURBINE BLADE ROOTS

GOVERNMENT CONTRACT

The United States Government has rights in this invention pursuant to Contract No. N00024-79-C-4175 between Westinghouse Electric Corporation and the Department of Defense.

RELATED APPLICATION

This is a continuation-in-part of application Ser. No. 760,387, filed July 30, 1985, now abandoned.

BACKGROUND OF THE INVENTION

This invention relates to steam turbine blades and more particularly to a method of making side entry turbine blade roots, grooves and steeples. Side entry turbine blades have Christmas tree-shaped roots which fit into similar shaped grooves in disc which form the turbine rotor. A unique geometry has been developed which helps minimize the stress concentration due to centrifugal and bending loads as the blades and the design can be scaled up or down over a range of sizes.

SUMMARY OF THE INVENTION

A method of making turbine blade roots, steeples, and grooves so that the stress concentration in each blade root and steeple are equal, when performed in accordance with this invention comprises the steps of forming the blade roots, grooves, and steeples so that they have the same shape; forming the blade roots and steeples to have inclined surfaces which provide the only contact area between the blades and the steeples; providing a proportional dimensional model of a blade root, groove and steeple whereby any size blade root, steeple and groove can be scaled from the dimensional model by multiplying all the dimensions on said model by a constant.

BRIEF DESCRIPTION OF THE DRAWINGS

The objects and advantages of this invention will become more apparent by reading the following detailed description in conjunction with the accompanying drawings, in which.

DESCRIPTION OF THE PREFERRED EMBODIMENT

Figure 1:
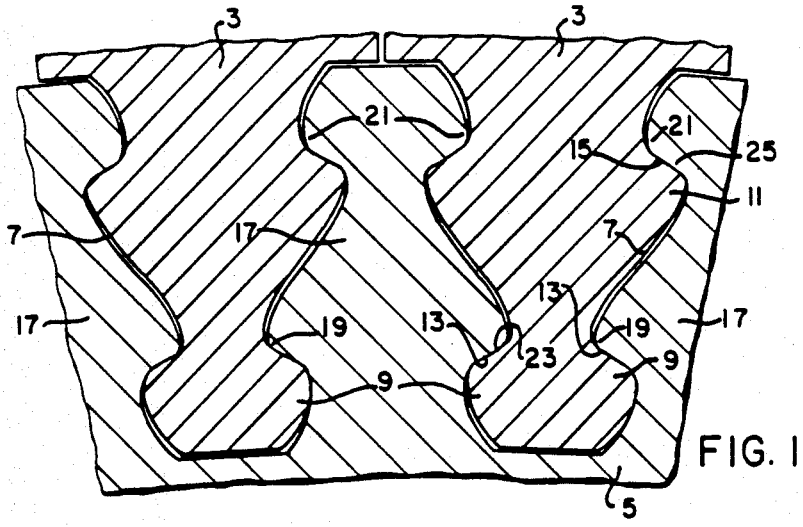
FIG. 1 is a partial sectional view of a turbine disc showing turbine blade roots, grooves and steeples made in accordance with this invention.

Referring now to FIG. 1 in detail, there is shown a root portion 3 of a turbine blade and a portion of a rotor disc 5 having a blade groove 7 disposed therein. The blade roots 3 have two tangs 9 and 11 on each side thereof. The tangs 9 and 11 have inclined surfaces 13 and 15, respectively, disposed thereon. The grooves 7 which are shaped like the blade roots 3 form steeples 17 which are also shaped like the blade roots 3. The steeple 17 have two tangs 19 and 21 on each side thereof, the tangs 19 and 21 have inclined surfaces 23 and 25, respectively, which engage the inclined surfaces 13 and 15. This engagement being the only areas of contact between the blade roots 3 and the steeples 17.

The blade roots 3, groove 7 and steeples 17 are the same shape being designed to help minimize stress concentrations due to centrifugal and bending loads. The design is made scalable over a range of sizes. The scalable two tang side entry turbine blade root geometry herein described significantly reduces stress concentrations due to centrifugal and bending loads as compared to existing designs. An important improvement being due to the ratio of the inner versus outer radii contiguous with the inclined surfaces which is two in this design as opposed to one in previous designs. This ratio results in a more efficient use of material by equalizing the stress at all points of stress concentration. Finite element stress analysis has shown reduction in the maximum stress up to 28% for centrifugal loads and up to 30% for bending loads.

Figure 2:
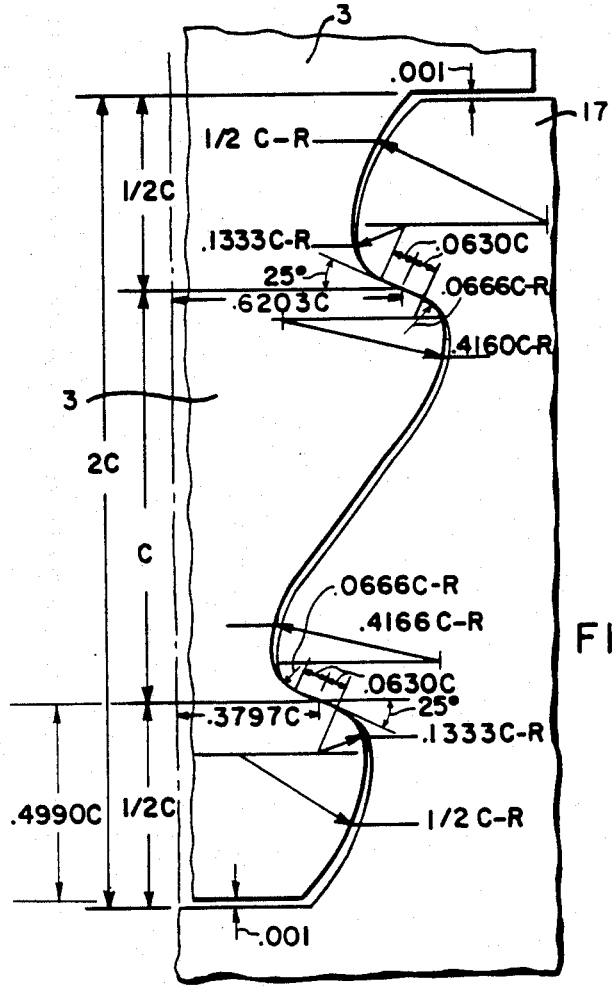
FIG. 2 is a partial dimensioned view of a dimensional proportional model of a blade root and steeple made in accordance with this invention.

The method of making the side entry turbine blade root 3, groove 7 and steeple 17 comprises the steps of:

forming the blade roots 3, groove 7 and steeples 17 so that they all have the same shape;

forming the blade roots 3 and steeple 17 so that they each have two tangs 9 and 11 and 19 and 21, respectively on each side with an incline surface 13 and 15 and 23 and 25, respectively, on each tang, these inclined surfaces being the only contact area between the blade roots 3 and the steeples 17 and being generally disposed at an angle of 25° with respect to a line normal to the center line of the blade root;

providing the proportional dimensioned model shown in FIG. 2 to form a blade root and steeple wherein the stresses are equalized at all points of stress concentration within the blade root and steeple;

setting the radial distance between the center of the inclined contact surfaces on the blade roots as C, a constant, setting the center of the radially outer inclined contact surface at 0.6203C from the central axis of the root, setting the center of the radially inner contact surface at 0.3797C from the central axis of the root, setting the center of the radially inner inclined surface 0.4990C from the radially inner end of the blade root and setting the other dimension at C times the numbers shown in FIG. 2 to produce a set of blade roots, grooves and steeples in which all points of stress concentration are equalized within each set of blade roots, and steeples as they are scaled up or down by varying the constant C which is equal to the distance between the central portion of the inclined surfaces projected at right angles to the center line of the blade root and generally equal to the distance between the center line of the steeple and the center line of the blade root at the location of the central portion of the radially inner inclined surfaces.

What is claimed is:

1. A method of making turbine blade roots, steeples and grooves so that stress concentrations in each blade root and steeple are equal, comprising the steps of:

forming the blade roots, grooves, and steeples so that they have matching shapes;

forming the blade roots and steeples to have inclined surfaces which abut, providing contact areas between the blade roots and steeples, these inclined surfaces being the only contact areas between the blade roots and steeples;

providing a proportional dimensional model of a blade groove root and steeple wherein any size blade root, steeple and groove can be scaled from said dimensional model by multiplying all dimensions on said model by a constant which is equal to a distance between a central portion of the inclined surfaces projected normal to a center line of the blade root; and providing constant angle inclined contact surfaces on said model whereby any set of blade roots, grooves and steeples scaled from said model has equal stress concentration at all points of stress concentration within each blade root and steeple.

2. A method as set forth in claim 1 and further comprising the step of providing blade roots and steeples having two tangs on each side and the tangs containing the inclined contact surfaces.

3. A method as set forth in claim 1 and further comprising the step of setting a ratio of radii of curved surfaces contiguous with the inclined surfaces generally at 2:1.

4. A method as set forth in claim 1 and further comprising the step of setting a distance between a center line of the steeple and a center line of an adjacent blade root at the central portion of radially inner inclined surfaces generally equal to the constant.

* * * * *